US006629875B2

(12) United States Patent
Steere, III

(10) Patent No.: US 6,629,875 B2
(45) Date of Patent: Oct. 7, 2003

(54) MACHINE FOR GRINDING-POLISHING OF A WATER EDGE

(75) Inventor: Robert E. Steere, III, Boonton, NJ (US)

(73) Assignee: Accretech USA, Inc., Oakland, NJ (US)

( * ) Notice: Subject to any disclaimer, the term of this patent is extended or adjusted under 35 U.S.C. 154(b) by 210 days.

(21) Appl. No.: 09/740,154

(22) Filed: Dec. 19, 2000

(65) Prior Publication Data

US 2001/0011002 A1 Aug. 2, 2001

Related U.S. Application Data

(63) Continuation-in-part of application No. 09/491,812, filed on Jan. 28, 2000, now abandoned.

(51) Int. Cl.[7] ..... B24B 49/00; B24B 51/00; B24B 21/00

(52) U.S. Cl. ..... 451/9; 451/44; 451/66; 451/297; 451/303; 451/307; 451/309

(58) Field of Search ..... 451/8, 9, 41, 43, 451/44, 297, 66, 299, 303, 307, 309, 10

(56) References Cited

U.S. PATENT DOCUMENTS 1,365,583 A * 1/1921 Brown ..... 451/310
5,725,414 A * 3/1998 Moinpour et al. ..... 451/41
5,868,857 A * 2/1999 Moinpour et al. ..... 134/6
5,908,347 A * 6/1999 Nakajima et al. ..... 451/5
5,928,060 A * 7/1999 Miller ..... 451/5
6,357,071 B2 * 3/2002 Moinpour et al. ..... 15/102
6,402,596 B1 * 6/2002 Hakomori et al. ..... 451/44

FOREIGN PATENT DOCUMENTS

JP 7-193030 * 7/1995

* cited by examiner

*Primary Examiner*—Timothy V. Eley
(74) *Attorney, Agent, or Firm*—Francis C. Hand; Carella, Byrne, Bain et al.

(57) ABSTRACT

The wafer edge processing unit may be a stand alone unit or may be incorporated in existing grinding machines. The processing unit employs a plurality of tapes which are coated with differing grades of grit to sequentially polish the edge of a rotating wafer or to remove an edge bead from a processed wafer or the other substrate. The tapes are mounted on a backing block which is rotated to move the tapes from a line contact with the top bevel of the wafer to a line contact with the bottom bevel of the wafer. Fresh surfaces of the tapes are presented to successive wafers by rotating the spools on which the tapes are mounted. The wafer may be moved in small increments along a Y-axis and/or an X-axis relative to a tape during polishing to improve the polishing operation.

33 Claims, 10 Drawing Sheets

MACHINE FOR GRINDING-POLISHING OF A WATER EDGE

This is a continuation-in-part of application Ser. No. 09/491,812, filed Jan. 28, 2000, which is now abandoned.

This invention relates to a wafer processing machine. More particularly, this invention relates to a processing unit for working the peripheral edge of a wafer used in the semiconductor industry. Still more particularly, this invention relates to a processing unit which can be used to polish the peripheral edge of a wafer or to remove edge bead material from the edge of a substrate such as a processed wafer.

As is known, various types of wafers, such as silicon wafers, have been employed in the manufacture of semiconductor chips. Typically, the wafers have been obtained by the slicing of a solid cylindrical ingot into individual wafers. Once cut, the wafers are processed in various manners and particularly to provide a peripheral edge of a predetermined contour. Various types of grinding machines have been employed for this purpose.

During the processing of a wafer into semi-conductor chips, it has been found that small sub-surface cracks or fractures at the peripheral edge of a wafer have a tendency of migrating into the wafer to such an extent that a significant portion of the wafer becomes unusable for the manufacture of the semi-conductor chips. Accordingly, it has become important to avoid the occurrence of cracks at the outer periphery of a wafer and particularly cracks which have a tendency of migrating into the wafer during subsequent processing.

It has also been known that processed wafers which have a film of material formed thereon, as by a spinning technique, usually have an edge bead of the material formed along the peripheral edge. As described in U.S. Pat. Nos. 4,510,176; 4,732,785; 5,444,921 and 5,618,380 several techniques have been described for removing the edge bead of material. Other techniques have also been described, for example, in U.S. Pat. Nos. 5,398,372 and 5,702,537 for removing an edge bead from a side edge of a strip of material.

Still further, it has been known that when applying several layers of material to a wafer, that each layer may thin at the peripheral edge of the wafer causing a subsequent flaking problem.

Accordingly, it is an object of the invention to provide a relatively simple technique for polishing the peripheral edge of a ground wafer to a high degree of polish to minimize fracture depth.

It is another object of the invention to provide a relatively simple polishing unit for the polishing of the peripheral edge of a wafer.

It is another object of the invention to provide a processing machine which can be used to remove an edge bead from a processed wafer or any other substrate.

It is another object of the invention to provide a relatively simple polishing unit for wafers which can be retro-fitted onto an existing wafer processing machines.

It is another object of the invention to provide a compact grinding/polishing machine for the processing of wafers for the semi-conductor industry.

Briefly, the invention provides a processing unit for working an edge of a substrate. The unit includes a first means for positioning a working medium against an edge of a moving substrate and a second means for moving the working medium an a plane perpendicular to the substrate during movement of the substrate to place the working medium in contact with at least one side of the moving substrate.

The processing unit may be employed as a polishing unit with the working medium for polishing the peripheral edge of a wafer or may be employed to remove an edge bead of material on the peripheral edge of a processed wafer or of a strip of material. In the one case, the working medium would be a polishing medium and, in the other cases, the working medium would be a grinding medium or any other suitable material for removing material from the substrate.

In one embodiment, the processing unit is constructed as a wafer edge polishing unit for polishing a peripheral edge of a wafer which is located on a rotating chuck. This polishing unit includes a first means for positioning at least one polishing medium against the peripheral edge of a wafer on the chuck as well as a second means for moving the polishing medium in a plane perpendicular to the chuck during rotation of the chuck in order to place the polishing medium in contact with at least one side of the wafer on the chuck.

In accordance with the invention, the means for positioning the polishing medium includes an elongated backing block facing the chuck, a pair of spools and at least one tape having the polishing medium thereon wound on and extending between the spools and over the backing block. In addition, a clamping means is provided, for example, in the form of a pair of clamps on opposite sides of the block, for releasably clamping the tape to the sides of the block.

The means for positioning the polishing medium is mounted in a stationary manner relative to the wafer mounting chuck so that the chuck is movable towards and away from the tape on a Y-axis. However, the means for positioning the polishing medium may also be mounted to move relative to the chuck along the Y-axis.

An elongated facing plate is movably mounted on the block and is disposed in backing contact with the tape in order to provide a rigid surface for holding the tape against the edge of a wafer being polished. In addition, a sensing means is provided for sensing movement of the facing plate in response to contact of the tape with a wafer on the chuck and for emitting a responsive signal thereto as a measure of the contact force between the tape and the wafer on the chuck.

Where the facing plate is made of a rigid material, an elastomeric layer is also provided to mount the rigid facing plate thereon. This elastomeric layer serves to cushion the contact force between the rigid facing plate and the wafer.

The sensing means which is employed for sensing the movement of the facing plate and, thus, the tape relative to the wafer, includes a beam which mounts the facing plate thereon, a pair of load cells which support the beam at two ends and which emit corresponding signals in reaction to movement of the beam and a read-out connected to the load cells to display a numeric indication of the signals.

The means for moving the polishing medium perpendicularly of the chuck is constructed to pivot the block on which the tape is mounted about a pivot axis which passes longitudinally of a face of the block and which is disposed in a plane of the wafer on the chuck. The pivoting action is such as to move the tape between a first position on one side of the chuck and a second position on the opposite side of the chuck.

During operation, the polishing unit is usually stationary and the chuck for holding the wafer is movable relative to the polishing unit. To this end, after a wafer has been centered on the chuck, the chuck is moved towards the polishing unit until the edge of the wafer contacts the polishing medium. During this time, the block on which the tape with the polishing medium is mounted is pivoted to bring the tape into a position for line contact with one side of the edge of the wafer, e.g. a top bevel surface. After contact is made, the wafer then rotates or continues to rotate so that the polishing medium on the tape is able to polish the entire circumferential extent of the top bevel surface of the wafer.

The polishing unit is programmed so that the block on which the tape is mounted is pivoted or otherwise moved in a plane perpendicular to the wafer so that the tape follows the contour of the edge of the wafer and is then brought into line contact with the opposite side of the edge of the wafer, e.g. a bottom bevel surface.

Typically, wafers are ground to have a peripheral edge with a contour of trapezoidal shape (i.e. a I-type) or with a rounded apex (i.e. an R-type) on a trapezoidal shape. During polishing, the polishing medium follows this contour to polish the surface of the shaped edge to a high finish.

In a preferred embodiment, the polishing unit is provided with a plurality of polishing mediums with each having a different grade of abrasive from the other. For example, the first polishing medium may have a large diamond grit while the last polishing medium in the series has a fine diamond grit.

In the preferred embodiment, four tapes having diamond grits of different grade are mounted in the polishing unit in parallel side-by-side relation. Typically, the wafer is brought into contact with the first tape of the series in order to have a course polishing operation conducted while the wafer is being rotated. Thereafter, the chuck on which the wafer is mounted is indexed laterally of the polishing unit in order to bring the next tape into contact with the peripheral edge of the wafer to perform a further polishing cycle. The wafer is indexed in a similar fashion until polishing by the last tape has been performed.

Upon completion of a polishing operation, the peripheral edge of the wafer has been provided with a mirror-like high grade finish.

The polishing unit can be readily incorporated into a grinding machine or retro-fitted into an existing grinding machine.

Typically, the polishing unit would be disposed in a machine having a grinding stage for grinding a wafer to a predetermined diameter and a conveyor for moving a wafer from the grinding station to the polishing station. After a wafer has been polished in the polishing unit, the same conveyor may be used to convey the polished wafer to a delivery point for mounting in a cassette or onto another conveyor for transportation to another processing unit.

The polishing unit may also be incorporated into a spin/rinse/dry station. In this embodiment, after a wafer has been ground and before being rinsed and dried, the wafer may be polished in the same station that would subsequently rinse and spin dry the wafer. This avoids the need to transfer the polished wafer to a rinse station.

As an alternative, a second conveyor may be positioned within the machine to transfer the polished wafer to a delivery point without interfering with the conveyor used to transfer the ground wafer to the polishing station. Such conveyors may operate in a parallel arrangement so as to limit the space required for the conveyors.

In other embodiments, the processing unit may be suitably adapted to work the edge of a processed wafer to remove an edge bead of material as by grinding or to work the edge of a moving strip to remove an edge bead of material therefrom.

These and other objects and advantages of the invention will become more apparent from the following detailed description taken in conjunction with the accompanying drawings wherein.

Figure 1:
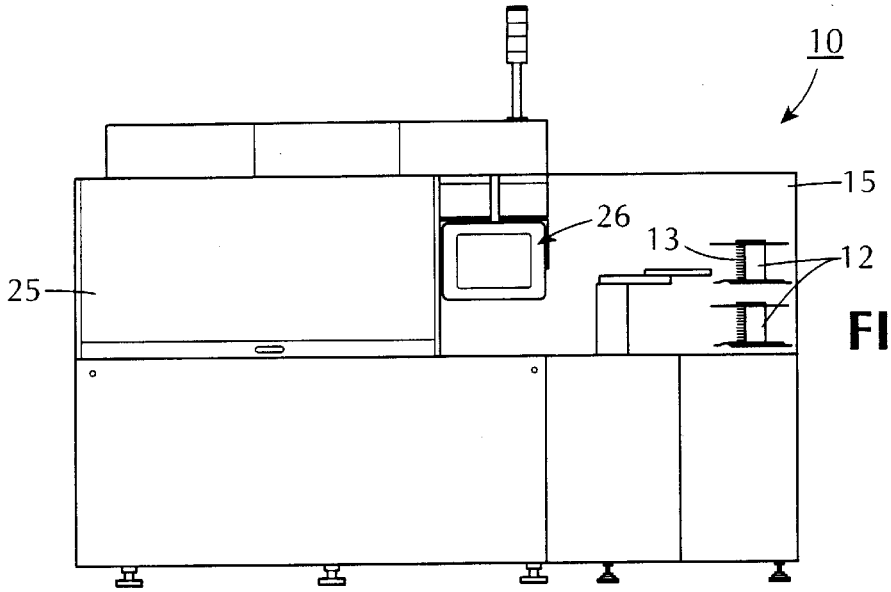
FIG. 1 illustrates a front view of a wafer grinding and polishing machine employing a polishing unit in accordance with the invention.
Figure 2:
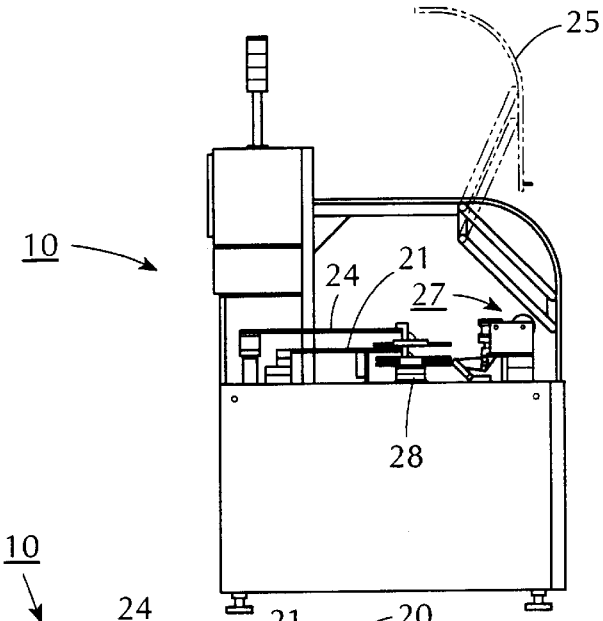
FIG. 2 illustrates a side view of the machine of FIG. 1.
Figure 3:
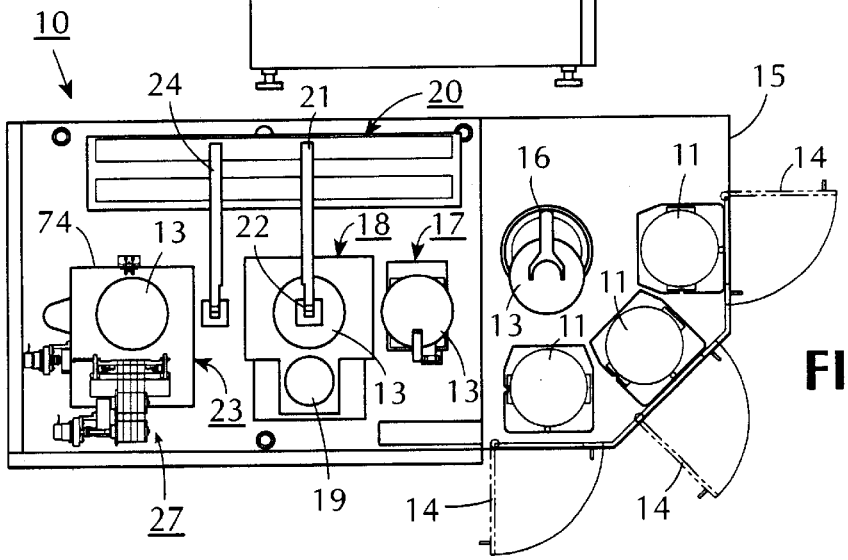
FIG. 3 illustrates a top view of the machine of FIG. 1.

Referring to FIGS. 1 to 3, the wafer grinding polishing machine 10 is constructed as a stand-alone unit and is but one example of a machine which may be used with a polishing unit in accordance with the invention.

Referring to FIG. 3, the machine 10 includes three cassette receiving stations 11 wherein, for example, two cassettes 12 (see FIG. 1) are received in vertically stacked relation in each station 11. Each cassette 12 includes a plurality of wafers 13 which are to be ground and polished.

The cassette receiving stations 11 also serve as delivery stations from which cassettes of ground and polished wafers may be removed from the machine. As indicated, each station 11 may be closed to the outside environment by a door 14 in a housing 15 which enclose the stations 11.

Referring to FIGS. 1 and 3, a robot 16 is also provided on a machine 10 for transferring a wafer 13 to and from the stations 11. The operation of the robot 16 is similar to that as described in U.S. Pat. No. 5,679,060 and need not be further described.

Referring to FIG. 3, the machine 10 also has a pre-alignment station 17 for receiving a wafer 13 from the robot 16. This pre-alignment station 17 operates in a conventional fashion and need not be further described. The machine 10 also has a grinding station 18 of conventional structure. Suffice to say, the grinding station 18 includes a rotatable grind wheel 19 for the grinding of a peripheral edge of a received wafer 13. In addition, the machine 10 employs a precision linear transfer conveyor 20 which employs a transverse arm 21 for transferring a wafer 13 via a chuck assembly 22 between the pre-alignment station 17 and the grinding station 18.

The machine 10 also has a spin/rinse/dry station 23 of conventional construction for receiving a wafer 13 via a second transverse arm 24 of the precision linear transfer conveyor 20. In general, the operation of the machine 10 and the various stations is well known and need not be further described.

As indicated in FIGS. 1 and 2, the machine 10 has a retractable cover 25 which is used to close over the pre-alignment station 17, grinding station 18 and spin/rinse/dry station 23 so that the various operations may be conducted in a closed environment.

As indicated in FIG. 1, a central processing unit 26 is provided with various controls and a display screen to automate the operation of the machine in a conventional manner.

Referring to FIG. 3, in accordance with the invention, a polishing unit or stage 27 is mounted in the spin/rinse/dry station 23 for polishing the peripheral edge of a ground wafer 13 delivered thereto.

Figure 6:
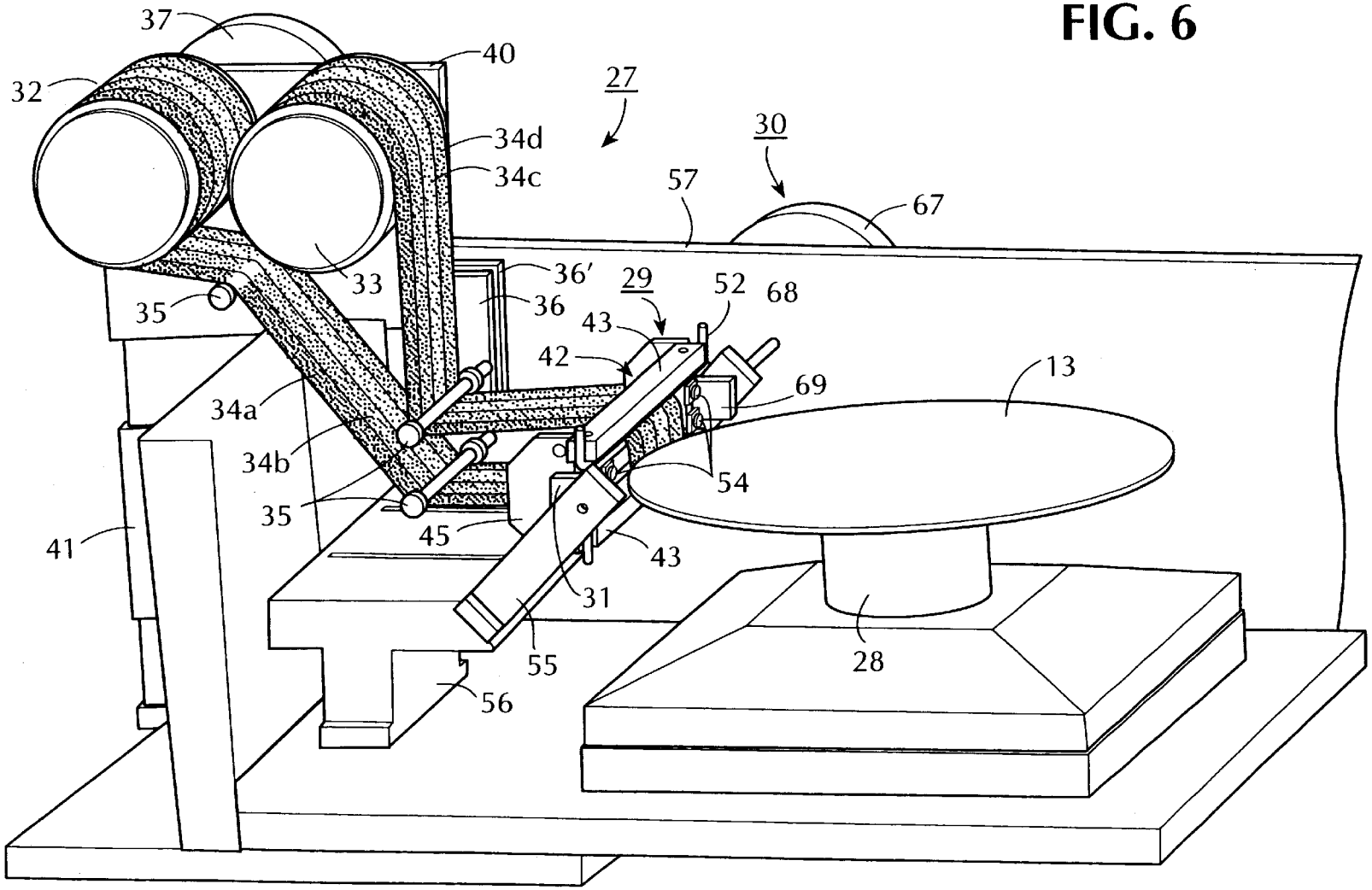
FIG. 6 illustrates a schematic view of the polishing unit prior to contact with a wafer in accordance with the invention.

Referring to FIG. 6, the polishing unit or stage 27 cooperates with a rotatable vacuum chuck 28 of the spin/rinse/dry station 23 which receives a wafer 13 thereon for rotation about a vertical axis of rotation in order to polish the peripheral edge of the wafer 13 during rotation of the chuck 28. This polishing unit 27 includes a means 29 for positioning a polishing medium against the peripheral edge of the wafer 13 as well as a means 30 for moving the polishing medium in a plane perpendicular to the chuck 28 between a first position placing the polishing medium in line contact with one side of the wafer 13 and a second position placing the polishing medium in line contact with an opposite of the wafer 13 while on the chuck 28.

Figure 4:
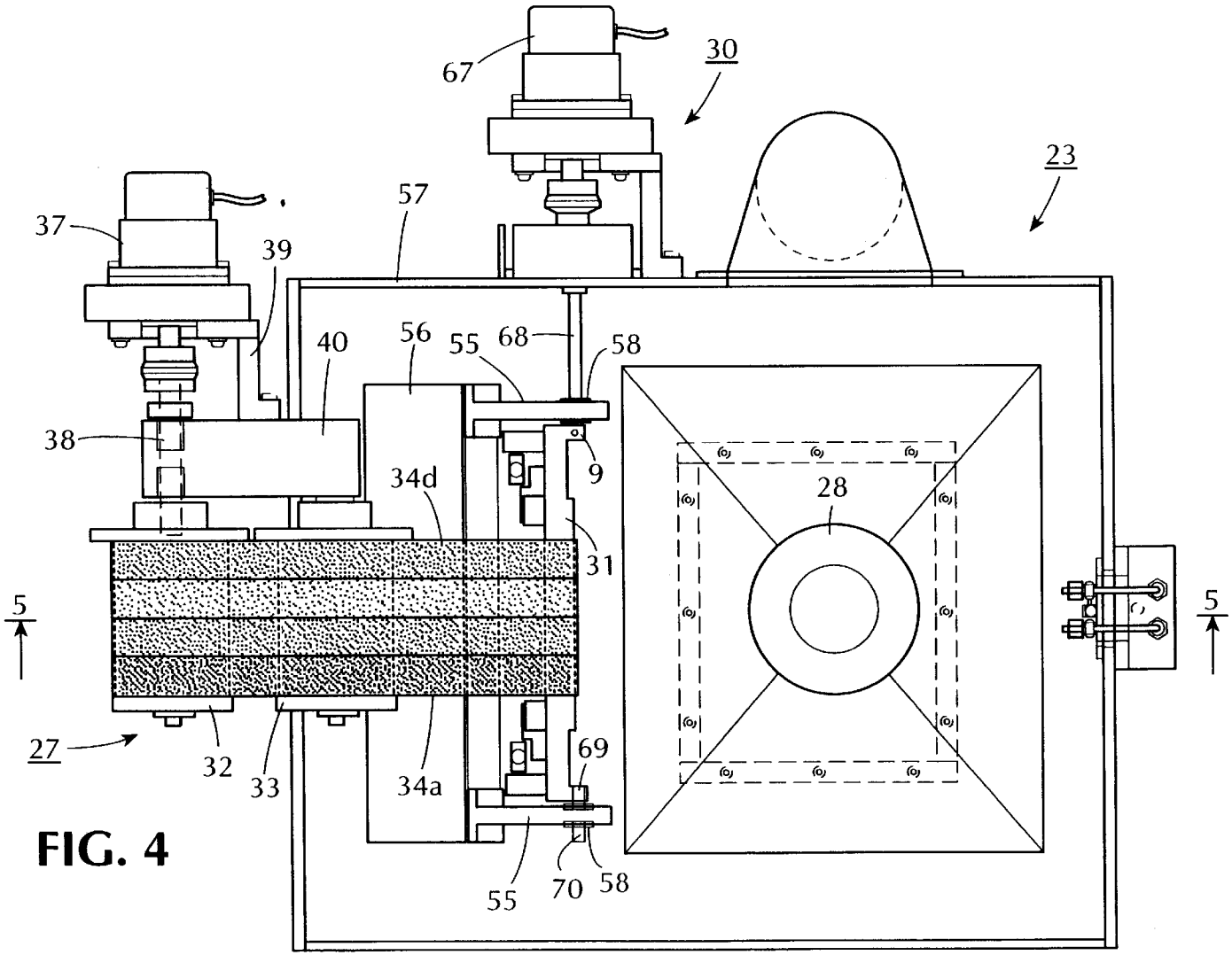
FIG. 4 illustrates a top view of a polishing unit employed in the machine of FIG. 1.
Figure 5:
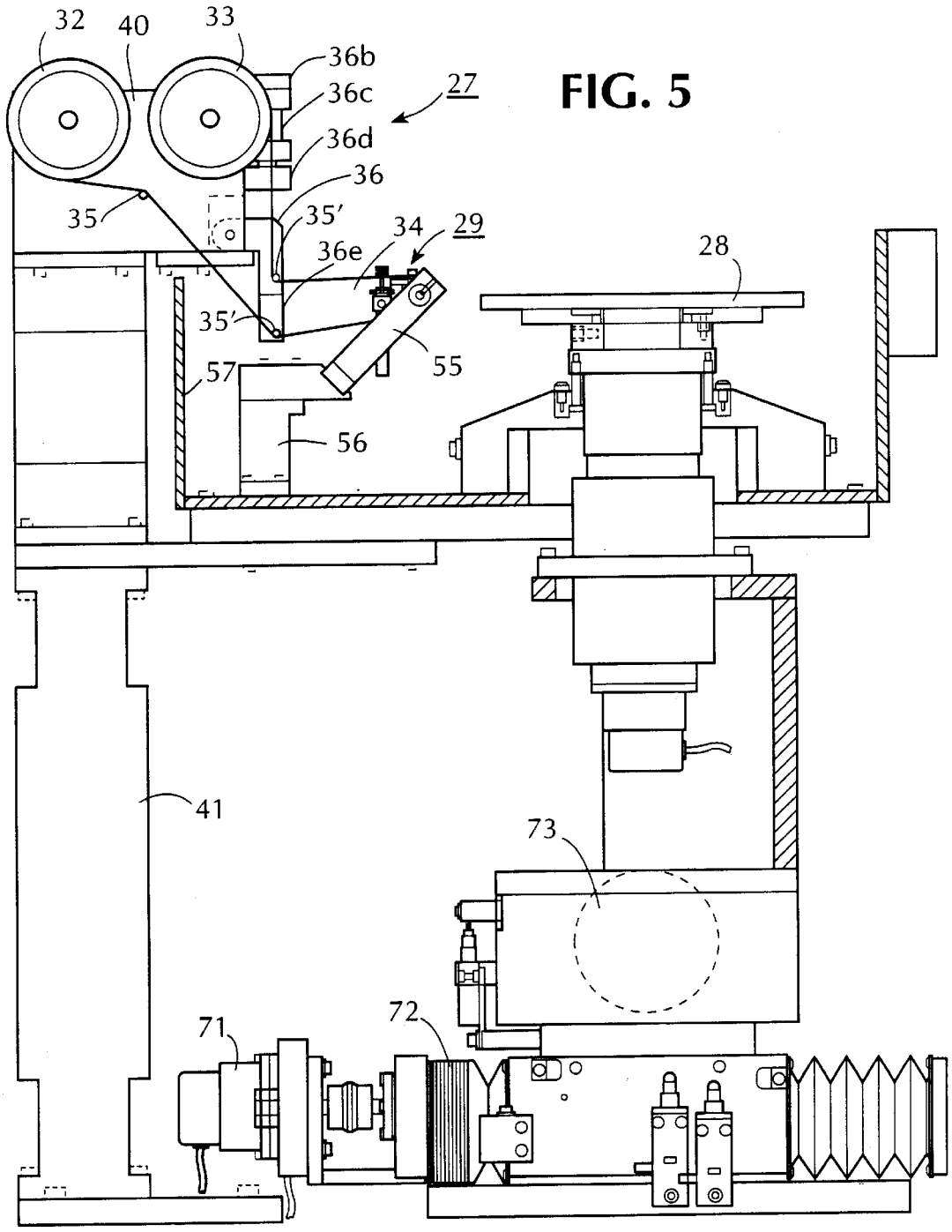
FIG. 5 illustrates a side view of the polishing unit of FIG. 4.

Referring to FIGS. 4, 5 and 6, wherein like reference characters indicate like parts as above, the means 29 for positioning a polishing medium against a wafer 13 includes an elongated backing block 31 which faces the chuck 28, a pair of spools 32, 33 and a plurality of tapes 34, e.g., four, each of which is wound on and extends between the spools 32, 33 and over the block 31. Each tape 34 has a polishing medium thereon for example, in the form of a diamond grit which varies in size from coarse to fine from the first tape 34*a* to the last tape 34*d* in the series.

As shown in FIGS. 5 and 6, the tapes 34*a–d* are guided between the spools 32, 33 over guide pins or rollers 35, 35' which are mounted on an upstanding housing 40 of the polishing unit 27. The rearmost guide pin 35 is fixedly mounted on the housing 40. Each of the foremost pair of guide rollers 35' is mounted on a lower leg of an L-shaped lever 36,36' which, in turn, has a vertical leg pivotally mounted on the housing 40 about an axis parallel to the axes of the rollers 35'. The pivot mounting of each guide roller 35' allows these guide rollers 35' to react to and follow the movement of the backing block 31 and tapes 34 from one side of a wafer 13 to the opposite side of the wafer 13.

Referring to FIG. 5, a blocking mechanism 36" is provided to lock the guide rollers 35' from pivoting while the tapes 34 are being incremented to a new surface. The blocking mechanism 36" includes an air cylinder 36*a* which pushes a block 36*b* down against the upper legs of the "L" shaped levers 36,36' in order to prevent pivoting of the levers 36,36'.

As indicated in FIG. 4, a motor 37 is provided on the polishing unit 27 for driving one spool 32 as a wind-up spool via a suitable transmission 38 while the other spool 33 follows along as a take-off spool. Upon activation of the motor 37, the spools 32, 33 are rotated in increments so as to move a fresh surface of the tapes 34*a–d* over the face of the block 31. As shown, the motor 37 is fixedly mounted by a bracket 39 to a housing 40 which houses the transmission 38 of the spools 32, 33. The housing 40 is, in turn, fixedly secured to a mounting block 41 (see FIG. 5) in a suitable manner.

Figure 14:
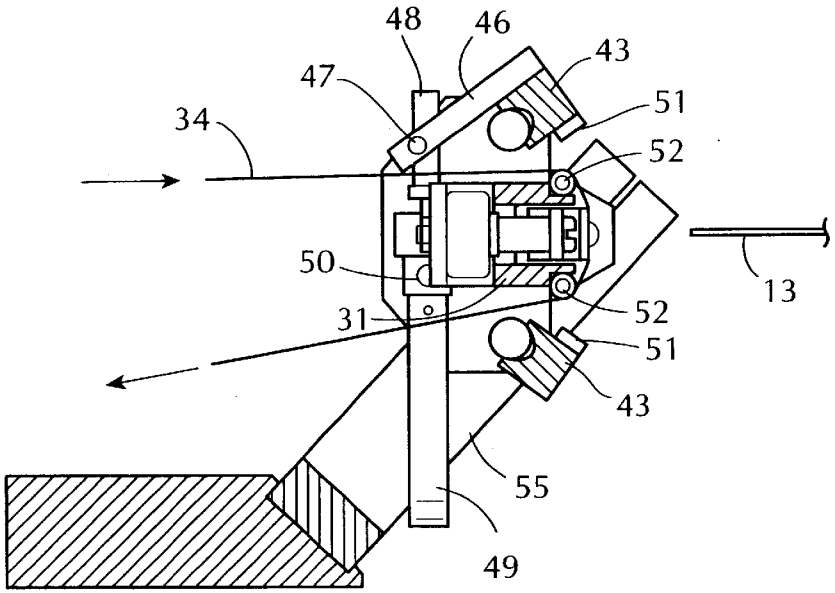
FIG. 14 illustrates a view of the clamping means in a released condition.
Figure 13:
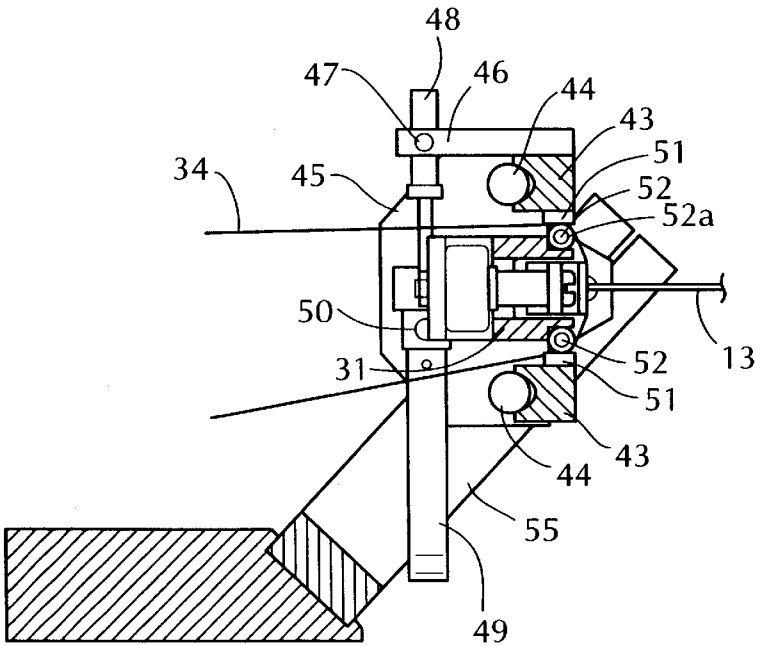
FIG. 13 illustrates a cross-sectional view of a clamping means for releasably clamping the polishing tapes during a polishing operation.

Referring to FIGS. 6, 13 and 14, a clamping means 42 is provided for releasably clamping the tapes 34*a–d* to the block 31 and includes a pair of clamps 43 which are disposed to opposite sides of the block 31. Each clamp 43 is movable between a closed position as shown in FIG. 13 and an open position as shown in FIG. 14 relative to the block 31.

Referring to FIG. 13, the upper tape clamp 43, as viewed, is mounted on a pin 44 or axle which is rotatably mounted at each end in a plate 45 and is fixed to a lever arm 46 which is pivotally connected by a pin 47 to a reciprocating piston 48 of an air cylinder 49. When the piston 48 is moved from the extended position of FIG. 13 to the retracted position of FIG. 14, the upper clamp 43 rotates about the fixed axle 44 into the open position of FIG. 14.

Figure 12:
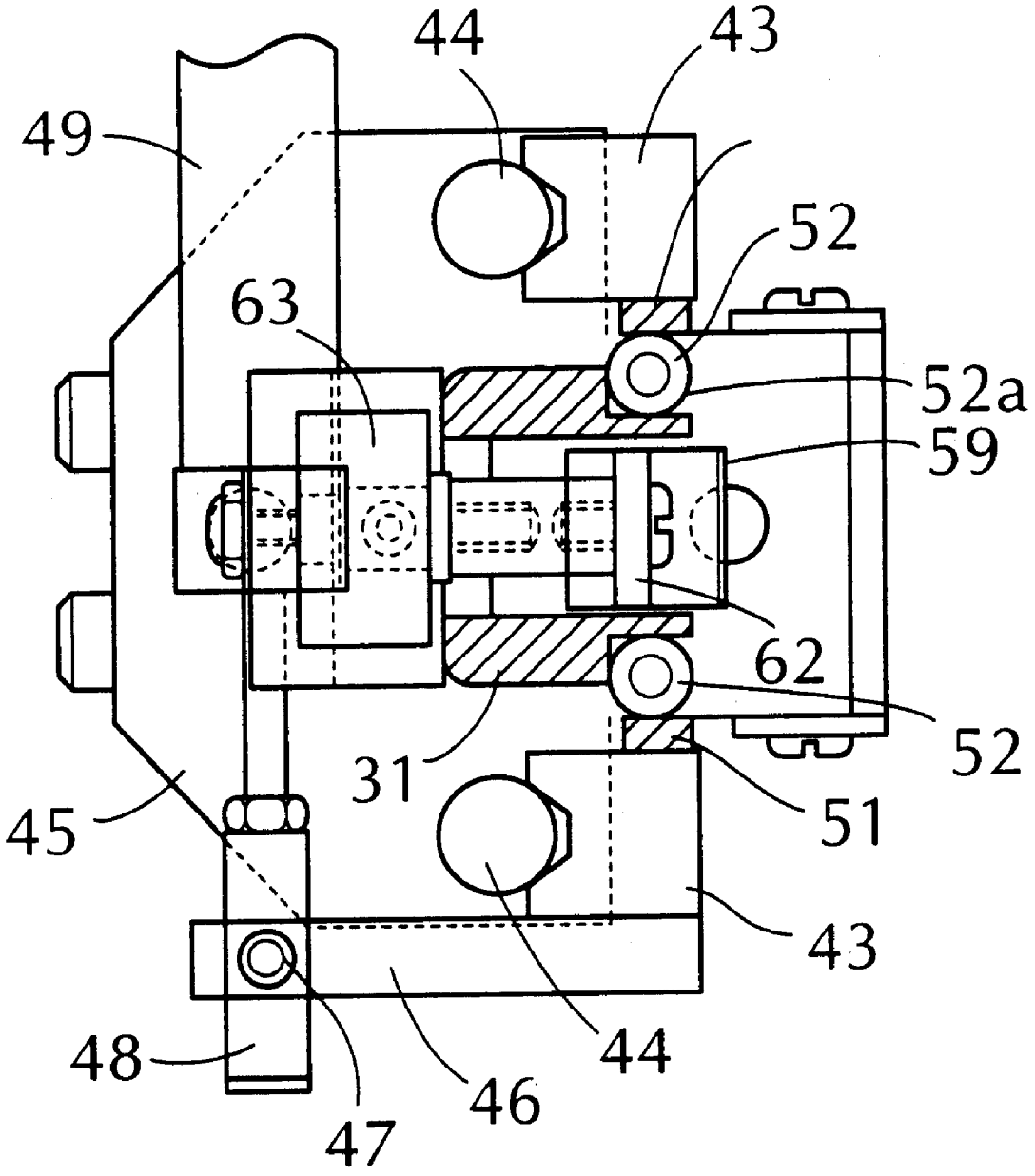
FIG. 12 illustrates a view taken on line 12—12 of FIG. 10.

The lower tape clamp 43 is also mounted on a rotatable pin or axle 44 which is actuated by a piston and cylinder arrangement as indicated in FIG. 12 on the opposite end of the bar 31.

The air cylinder 49 is mounted via a pivot pin 50 on the plate 45 to accommodate the retraction and expelling motions of the piston 48.

Figure 10:
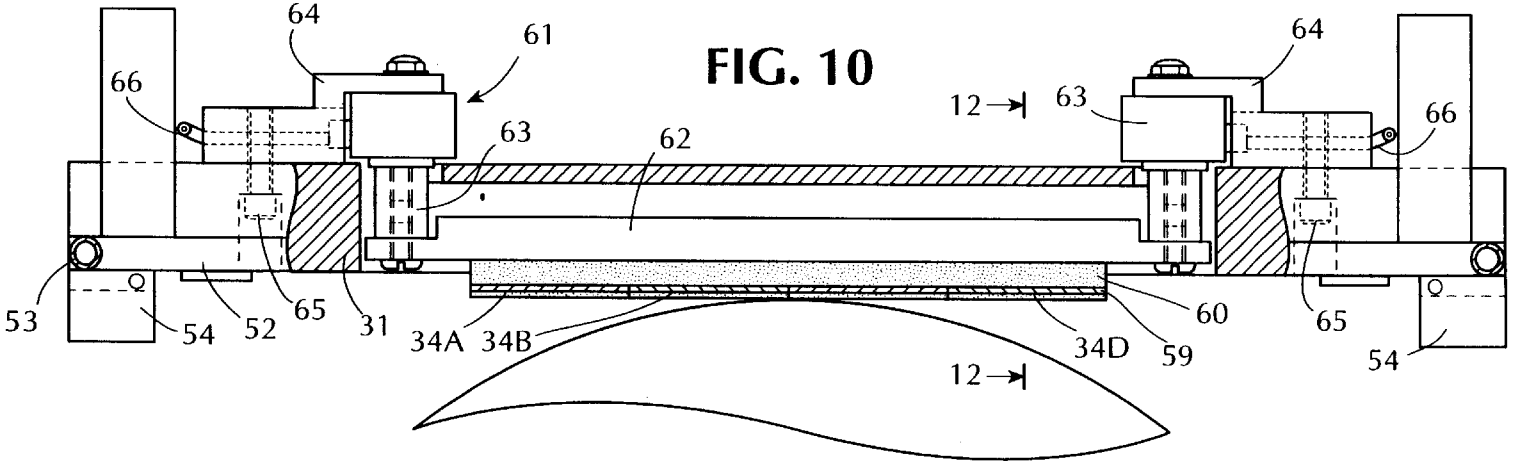
FIG. 10 illustrates a partial top view of a sensing means incorporated in a tape backing block for sensing the movement of a tape relative to a wafer during polishing.
Figure 11:
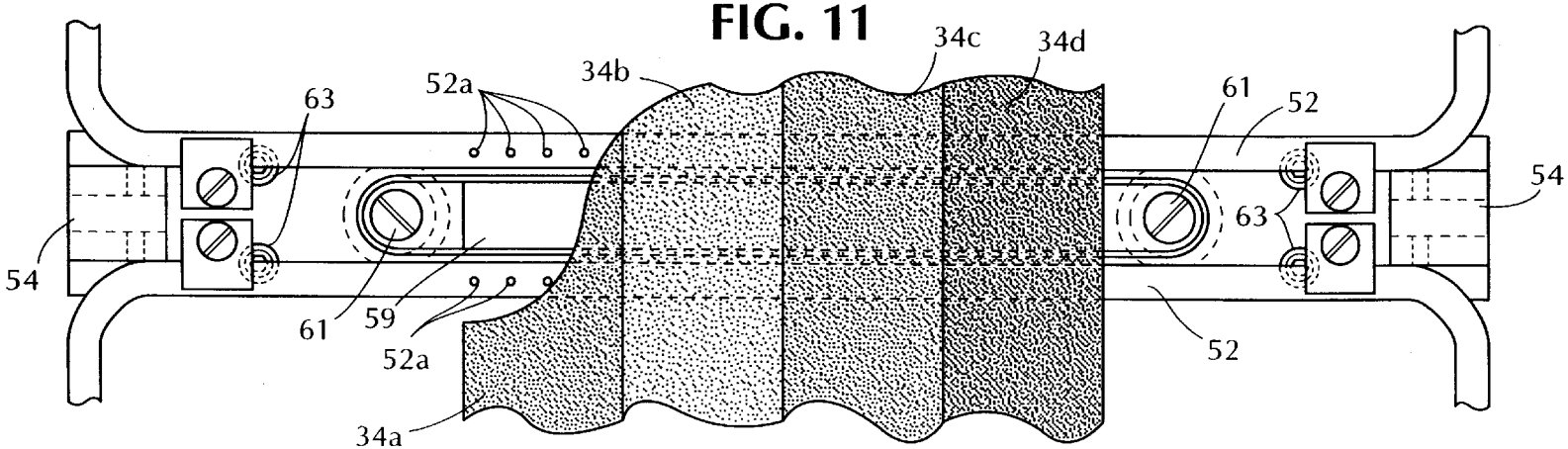
FIG. 11 illustrates a front view of the tape backing block of FIG. 10.

Referring to FIG. 13, each clamp 43 carries a resilient pad 51 for engaging against the tapes 34. In addition, the backing block 31 may be rounded at the corners to avoid sharp edges which might damage the tapes 34. Alternatively, as indicated in FIGS. 10, 11 and 13, the backing block 31 carries a pair of hollow stainless steel tubes 52 in a recess along the top edge and a recess along bottom edge for placement against the tapes 34. As shown in FIG. 11, each tube 52 is provided with a plurality of ports 52*a* to expel jets of air against the back of the tapes 34 to assist in lift-off of the tapes 34 from the backing block 31 when the tapes 34 are to be incremented forwardly. Each tube 52 has a plug 53 at one end and is connected at the opposite end to a source of pneumatic pressure (not shown). Suitable clamps 54 are provided on the block 31 .n order to position the tubes 52 at the respective ends of the block. The tubes 52 define a rounded surface so that the tapes 34 may be threaded over the face of the backing block 31 without being exposed to sharp corners. When the clamps 43 are in the closed position, the pads 51 on the clamps 43 and the tubes 52 serve as means for releasably gripping the tapes 34 at the sides of the backing block 31.

Referring to FIGS. 4 and 5, the backing block 31 is mounted between two end brackets 55, which, in turn, are fixed to a mounting block 56 which is fixedly mounted on the housing 57 of the spin/rinse/dry station 23. As indicated, the backing block 31 is rotatably mounted via suitable bearings 58 in the end brackets 55 as described below.

Referring to FIGS. 10 and 11, the backing block 31 carries an elongated rigid facing plate 59 which is movably mounted in a recess of the block 31 and which is disposed in backing contact with the tapes 34*a–d* in order to provide a rigid back for holding a tape 34 against the edge of a wafer 13 being polished. The rigid facing plate 59 is also mounted on an elastomeric layer 60 e.g. of sponge rubber which serves to cushion the contact force between the facing plate 59 and the wafer 13. In addition, a sensing means 61 is provided for sensing movement of the facing plate 59 in response to contact of a tape 34 with a wafer 13 and for emitting a responsive signal as a measure of the contact force between the tape 34 and the wafer 13. As shown, the sensing means 61 includes a beam 62 to which the elastomeric layer 60 is secured and which is mounted at the ends on a pair of load cells 63. Each load cell 63 is mounted on a bracket 64 which is secured to the back of the backing block 31 by pairs of bolts 65 and is of conventional structure and need not be further described. Further, each load cell 63 senses a movement of the end of the beam 62 thereat and emits a corresponding signal in reaction to the movement of the beam end. The load cells 63 are connected via electrical lines 66 to a readout (not shown) mounted on the display 26 (see FIG. 1) in order to have a numeric indication of the signals displayed.

The sensing means 61 allows a user to determine the contact force between a wafer 13 being polished and a polishing medium carrying tape 34. Further, the polishing unit 27 may be programmed so that the amount of contact force sensed between the polishing medium carrying tape and the wafer controls the operation of the polishing unit 27. For example, if the contact force sensed is higher than a programmed value, the wafer can be backed away from the polishing unit 27 so as to reduce the force while continuing a polishing action.

Referring to FIGS. 4 and 6, the means 30 for moving a polishing medium in a plane perpendicular to the chuck, i.e. in a vertical plane, as viewed includes a motor 67 which is mounted on the housing 57 of the spin/rinse/dry station 23 and which drives a shaft 68 which is fixed to the elongated backing block 31 for rotating the block 31 about the axis of the shaft 68.

Figure 7:
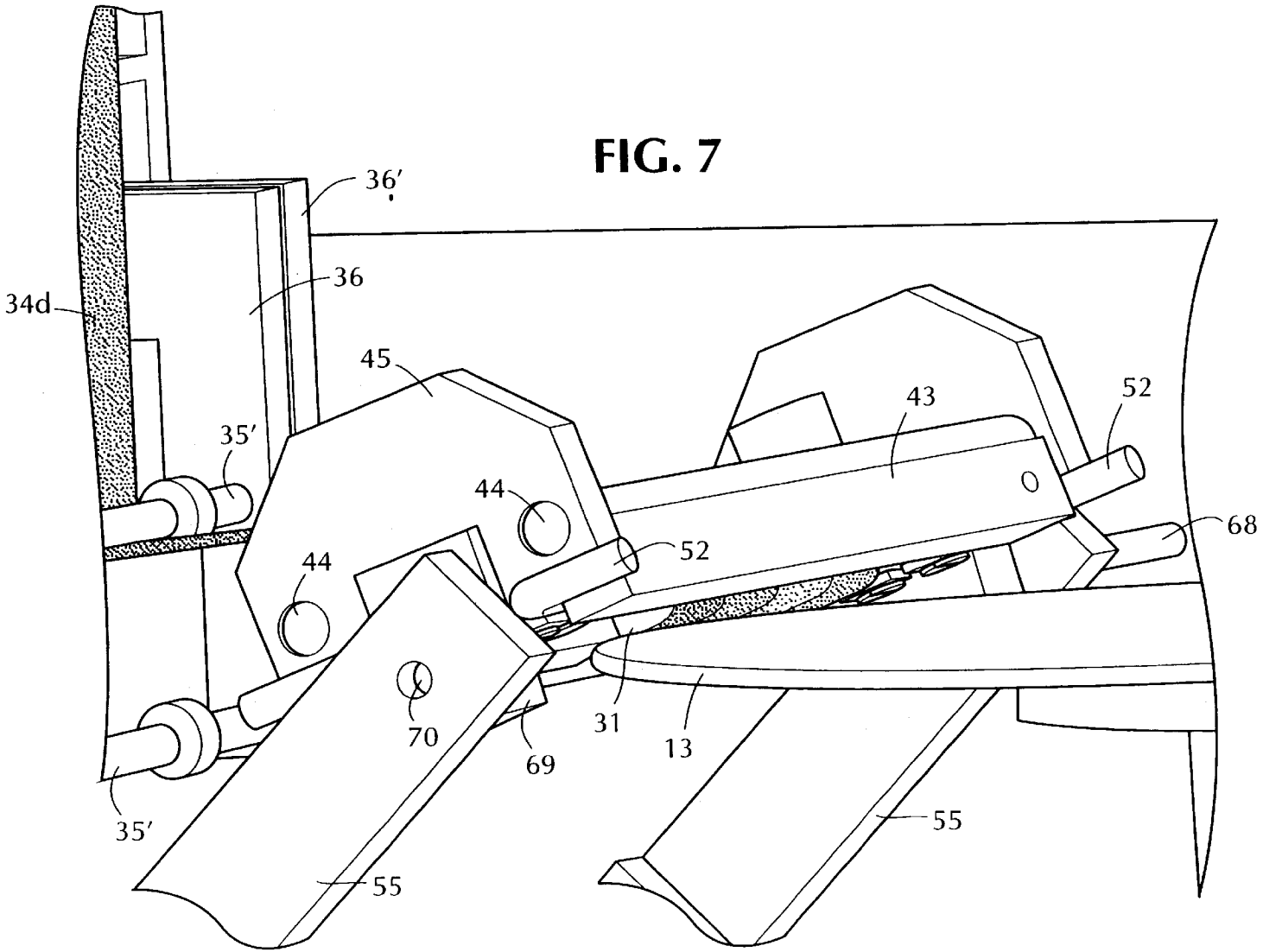
FIG. 7 illustrates a view of the polishing unit during polishing of an upper edge surface of a wafer.
Figure 8:
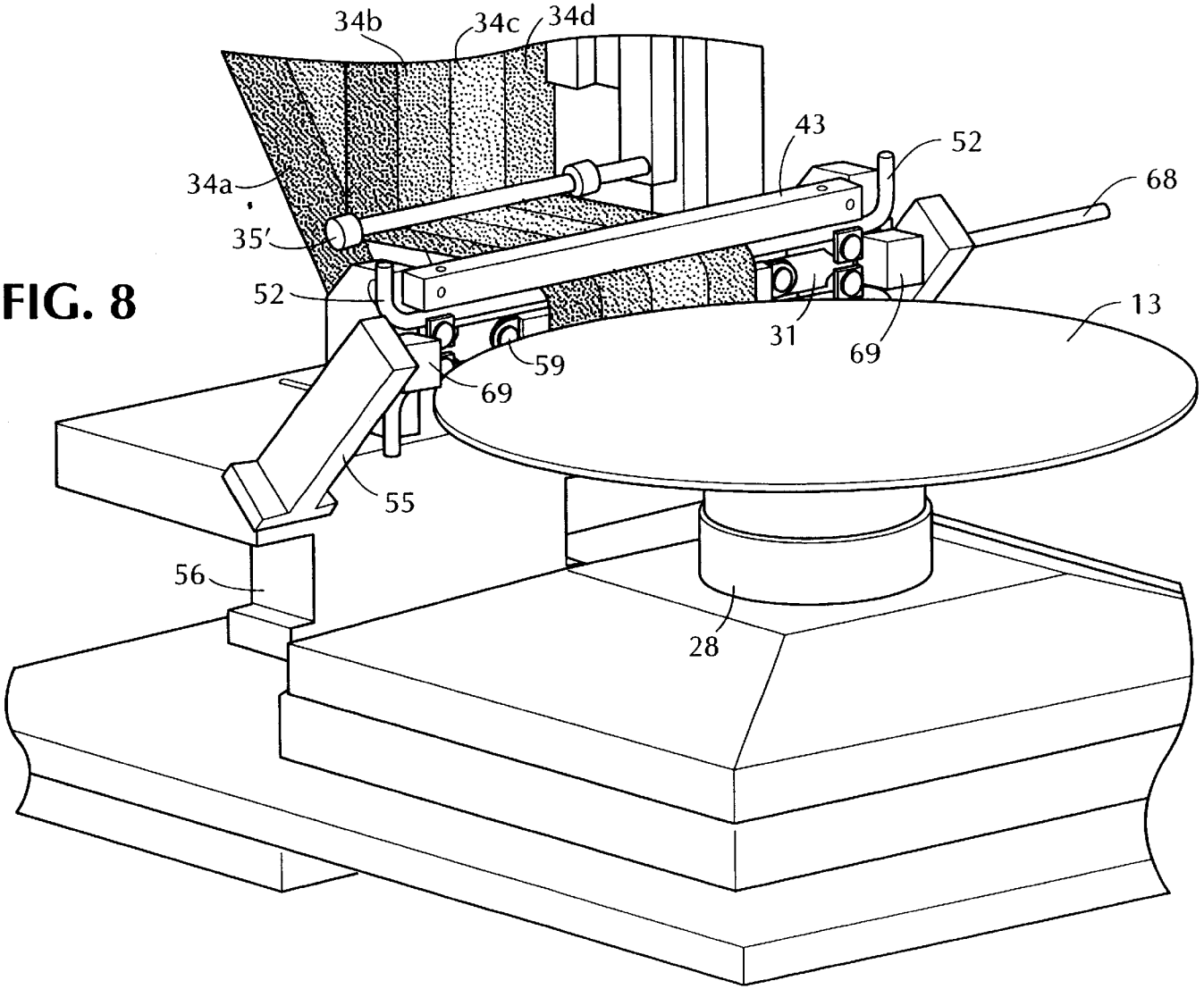
FIG. 8 illustrates a view of the polishing unit during polishing of the edge of a wafer.
Figure 9:
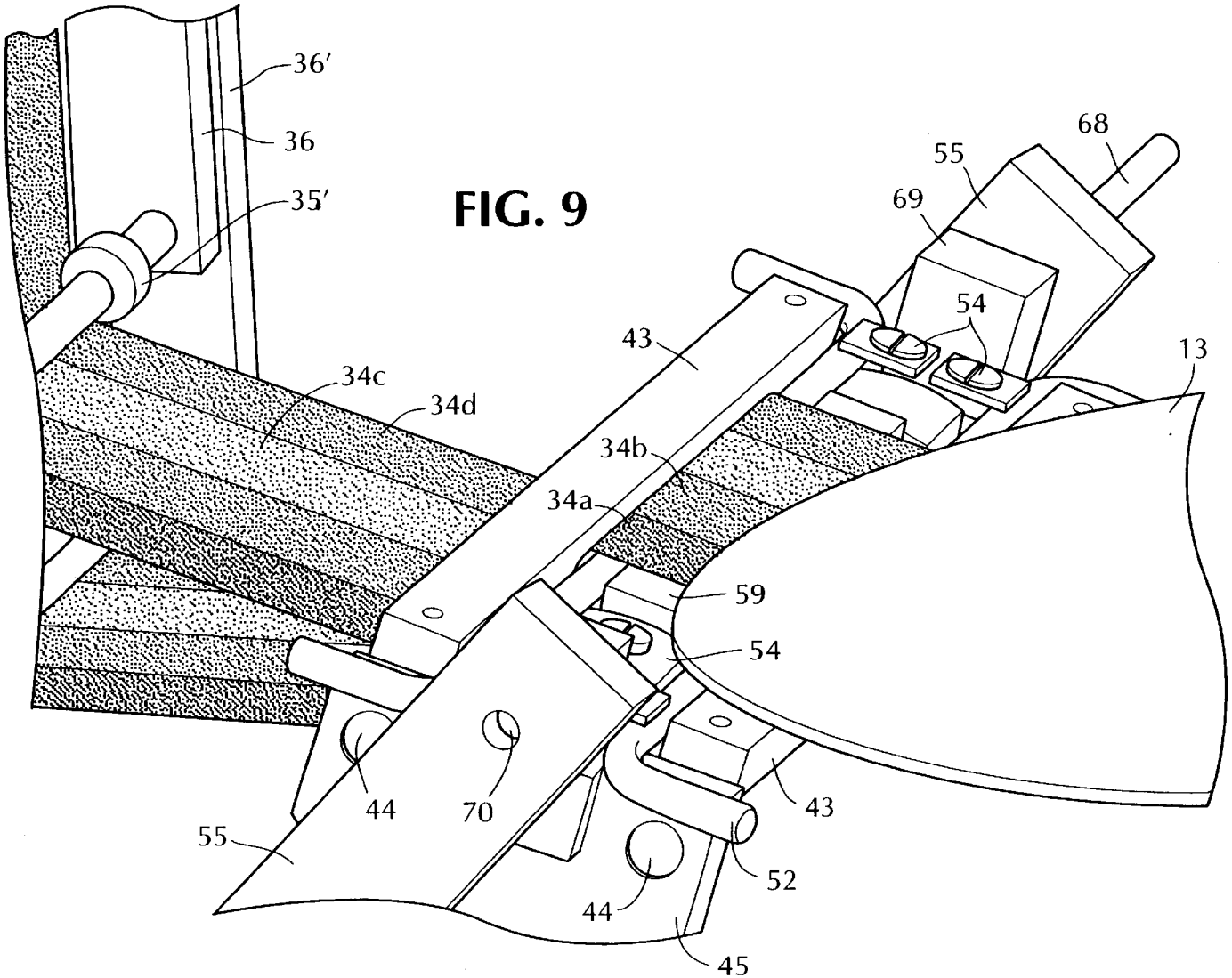
FIG. 9 illustrates a view of the polishing unit during polishing of a bottom bevel surface of a wafer in accordance with the invention.

As shown in FIGS. 4 and 8, the backing block 31 has a pair of perpendicularly disposed ears 69 at the ends. One ear 69 is secured to the end of the motor shaft 68 which, in turn, is journalled in the bearing 58 in a bracket 55. The second ear 69 is secured to a pin 70 which is journalled in the bearing 58 of the other bracket 55. In this way, the longitudinal axis of the block 31 is offset from the axis of the shaft 68 to the motor 67. Thus, depending upon the direction of rotation of the shaft 68, the block 31 may be moved into a top bevel polishing position as shown in FIG. 7 or into a bottom bevel polishing position as shown in FIG. 9.

Referring to FIG. 5, wherein like reference characters indicate like parts as above, a motor 71 is provided below the chuck 28 of the spin/rinse/dry station for driving a lead screw arrangement 72 so as to move the chuck 28 along a Y-axis towards and away from the polishing unit 27. In addition, a second motor 73 is provided with a similar lead screw arrangement (not shown) for moving the chuck 28 transversely of the polishing unit 27 along an X-axis. These controls are well known and need not be further described.

During operation, after a wafer 13 has been delivered to the chuck 28 of the polish/rinse/dry station 23 and centered thereon, the chuck 28 is moved towards the polishing unit 27, for example, toward the position illustrated in FIG. 6. At this time, the chuck 28 is programmed to rotate the wafer 13 while the polishing unit 27 is programmed to rotate the block 31 into the top bevel polish position shown in FIG. 7. Assuming that the wafer has been previously provided with a ground edge of trapezoidal shape, the upper bevel at the peripheral edge of the wafer 13 is moved into line contact with and is polished by the polishing medium on the first tape 34*a* while the line contact is maintained between the tape 34*a* and the wafer 13.

After a programmed time has expired, the block 31 of the polishing unit is rotated towards the position as shown in FIG. 8. If the wafer 13 has an R-type edge, i.e. a radiused edge, the block 31 continues to pivot towards the position of FIG. 9 while a point contact is maintained between the tape 34*a* and the wafer 13. If the wafer 13 has a T-type edge, i.e. a flat peripheral edge separated by a radius from each bevel surface, the block 31 first pivots to maintain a point contact with the first radius, then pauses to maintain a line contact with the flat edge and then pivots to maintain a point contact with the second radius. At the programmed time, the block 31 is further rotated into the bottom bevel polishing position of FIG. 9 in order to polish the bottom bevel on a line contact. Next, the chuck 28 on which the wafer 13 is positioned is moved away from the tape 24*a* along the Y-axis, indexed along the X-axis parallel to the block 31 of the polishing unit 27 and then moved toward the next tape 24*b* along the Y-axis so that the peripheral edge of the wafer 13 comes into contact with the second polishing medium on the second tape 34*b*. Again, after this polishing operation has expired, the chuck 28 is again moved and indexed to bring the wafer into contact with the succeeding polishing mediums. In this way, the wafer is sequentially exposed to a series of polishing mediums from coarse to fine.

As a practical matter, each time a fresh wafer is presented to the polishing unit, the tapes are indexed forwardly to present a fresh polishing surface. For this purpose, the clamps 43 are moved from the position shown in FIG. 13 to the released or open position shown in FIG. 14. At this time, the motor 37 for driving the spools 32, 33 is actuated to increment the tapes 34*a–d* forwardly to present fresh polishing surfaces to the wafer. Next, the clamps 43 are returned to the clamping position shown in FIG. 13. Thereafter, a polishing operation may be conducted as described above.

During a polishing operation, a suitable cutting fluid may be supplied to the peripheral edge of the wafer for polishing thereof.

The polishing unit may be programmed in various fashions in order to effect a polishing operation. For example, it has been found that by moving the chuck 28 back and forth along the feed or Y-axis once the wafer 13 has made contact with a tape 34, the cutting fluid is more efficiently able to penetrate the point of polishing and carry off silicon debris to prevent loading on the tape. This technique also provides a small amount of relative movement which leads to better surface averaging.

A second technique causes the wafer to move along the X-axis parallel to the polishing tapes so as to expose more abrasive to the wafer. More abrasive provides a better canceling of high points and results in shallower grooves along the circumference of the wafer. The cutting fluid efficiency also increases as the wafer moves across the tape.

A third technique is a combination of the two above techniques wherein the wafer is moved back and forth simultaneously in the X-axis and the Y-axis directions. The Y-axis direction motion increases the efficiency of the cutting fluid and the X-axis direction exposes more abrasive to the edge of the wafer for better surface averaging.

The polishing unit is constructed so that the worn polishing tapes may be readily replaced with fresh tapes. For example, with the clamps 43 moved into the open position of FIG. 14, the terminal ends of the tapes are threaded past the clamps 43 and the tapes are wound up on the wind-up spool. The wind-up spool is then removed. The empty take-off spool is then removed and replaced by a fresh take-off spool of tapes. These tapes 34 are then threaded over the backing block 31 and attached to a fresh wind-up spool. In this respect, the empty take-off spool may serve as the wind-up spool by being mounted in that position. Alternatively, separate rolls of tape may be mounted on a common cylinder or core to form a spool of tapes. In this case, the individual rolls of tape may be separately mounted in place or removed when used.

One or both of the clamps 43 may be provided with a sensor means (not shown) to indicate when the clamp 43 is in the closed position of FIG. 13. For example, the sensor means may include a flag in the form of a bar (not shown) or the like which is able to pivot with the clamp 43 and which cooperates with a sensor (not shown) mounted in a fixed position on the block 31 to indicate when the clamp 43 or clamps 43 are in the closed position of FIG. 13. Such a sensor may be of a capacitance type to emit a signal when the bar is in the position corresponding to the closed position of the clamps 43.

The polishing unit may also employ a blocking means (not shown) to prevent the movable levers for the foremost guide rollers 35' from pivoting during the time the tapes 34 are being incrementally moved to present fresh polishing surfaces on the block 31.

While the spooling unit has been described as being stationary while the wafer to be polished is moved relative to the polishing unit, it is possible to also have the polishing unit moved transversely relative to the rotating wafer so as to bring successive polishing mediums into contact with the rotating wafer. Likewise, it is also possible to maintain the rotating wafer about a fixed axis of rotation while the polishing unit is moved towards or away from the edge of the wafer.

Still further, while the polishing unit is shown operating on a wafer which is disposed on a horizontal plane, the wafer may be mounted in a vertical plane and the polishing unit oriented to accommodate a vertically disposed wafer.

While four tapes have been described for use with the polishing unit, it is also possible to use one or two tapes to carry out a polishing operation.

Typically, during a polishing operation, the polishing tape 34 is in line contact with the top bevel at the edge of the wafer or the bottom bevel of the wafer while being in point contact with the edge of the wafer between the two bevels. Typically, the edge of the wafer is of a slightly rounded contour. If the wafer has a flat peripheral edge, the polishing tape would be held stationary, for example, from two to three seconds in order to polish the flat surface of the wafer.

Once a wafer has been polished, a wafer may then be rinsed and spun dry in a conventional manner. Thereafter, the wafer is removed, as is conventional, to a delivery cassette at the delivery station 11 (see FIG. 3) via the transverse arm 24 of the conveyor 20. In this respect, as indicated in FIG. 2, the transverse arm 24 is above the transverse arm 21 so that the finished wafer can be delivered directly to a position above the pre-alignment station 17 for takeoff by the robot 16.

Alternatively, after being polished, a wafer 13 may be lifted by a suitable vacuum arm 74 (see FIG. 3) and deposited onto the top of the transverse arm 24. For this purpose, a skeletal wafer holder arm (not shown) is mounted on the top of the transverse arm 24 and is provided with, for example, three openings in a triangular array through which a vacuum may be drawn to hold a wafer 13 thereon under a light suction force. In this embodiment, when the transverse arm 24 transports the polished wafer to adjacent the robot 16, the robot 16 is programmed to move along a Z-axis to rise up to the level of the wafer in order to lift the wafer from the skeletal wafer holder for transfer into a cassette 12.

The pivot axis for the elongated block 31 may be in the plane of the wafer 13 or may be positioned above or below the plane of the wafer, although these latter placements would require a more complicated movement of the block 31 to effect the polishing operation. In this respect, as the thickness of the wafers presented for polishing may be different from one cassette to another, the polishing unit 27 is programmed to accommodate the different thicknesses.

The polishing unit 27 may be programmed to begin a polishing operation after a wafer has been brought into contact with a tape 34 and a contact force of, for example, 400 grams is sensed by the sensing means 61. Thereafter, the polishing operation is performed as a time-based operation. Should it be found that a set of wafers requires less polishing time or more polishing time, the time of operation may be easily adjusted.

The polishing operation may also be programmed to use only one tape or to use any number of the tapes for a given wafer.

The invention thus provides a polishing unit which is relatively simple in construction.

Further, the invention provides a polishing unit which is able to polish a large number of wafers before requiring replacement of the polishing medium.

The invention further provides a polishing unit which may be retrofitted onto existing grinding machines in order to effect a polishing of the edge of ground wafers The invention also provides a polishing unit which employs polishing tapes and is therefore slurry-free as chemicals or lapping compounds are not required. Further, the polishing unit is able to maintain profile integrity of the wafer as a new tape surface is used for each wafer and there is no resin or soft bond wheel degradation and no need for truing for tool wear.

The polishing unit has minimal impact on the throughput of a grinding machine as the polish and grind processes can be performed at different stations simultaneously. Further, there is no time consuming grind wheel truing process required.

The polishing unit also provides the ability to tune the polishing process to meet specific requirements. For example, the grit sizes on the tape may be changed depending upon the requirements. Also, the number of tapes to be used is variable. Further, there is a full control of the contouring motion of the polishing unit.

One of the advantages of the use of the tapes is there is no metal contamination added by the use of the tape. Further, the tape removes any previous grinding wheel-induced metal contamination from the wafer.

The polishing unit may also be provided with a control (not shown) to move the chuck 28 along a Z-axis vertically up and down as viewed in FIG. 5. This control is well known and need not be further described.

Should the polishing unit be used for removing edge bead material from a processed wafer or to polish the edge of a process wafer in order to prevent flaking, the block 31 may be first positioned over the edge of the processed wafer. Thereafter, the wafer may be raised along the Z-axis until the edge of the wafer just kisses the medium on the block 31.

While the above description relates particularly to processed wafers, the polishing unit may also be used to remove material from a longitudinal edge of a moving substrate such as a strip of material.

What is claimed is:

1. A wafer processing machine comprising a chuck for holding a wafer thereon for rotation about an axis of rotation passing transversely through said chuck; and a wafer edge processing unit for working a peripheral edge of a wafer on said chuck during rotation of said chuck, said processing unit including a first means for positioning a working medium in a first position against the peripheral edge of a wafer on said chuck and a second means for moving said first means in a plane perpendicular to said chuck during rotation of said chuck to move the working medium from against the peripheral edge of the wafer into contact with at least one side of the wafer on said chuck.

2. A wafer processing machine as set forth in claim 1 wherein said first means includes an elongated backing block facing said chuck, at least one pair of spools, a tape wound on and extending between said spools and over said block and having one of a polishing medium and a grinding thereon, and a pair of clamps on opposite sides of said block for releasably clamping said tape to opposite sides of said block.

3. A wafer processing machine as set forth in claim 2 wherein said first means includes an elongated facing plate movably mounted on said block and disposed in backing contact with said tape, and sensing means for sensing movement of said facing plate towards said block in response to contact of said tape with a wafer on said chuck and emitting a responsive signal thereto as a measure of a contact force between said tape and a wafer on said chuck.

4. A wafer processing machine as set forth in claim 3 wherein said facing plate is made of rigid material and which further comprises an elastomeric layer having said facing plate mounted thereon.

5. A wafer processing machine as set forth in claim 3 wherein said sensing means includes a beam mounting said facing plate thereon, a pair of load cells supporting said beam and emitting corresponding signals in reaction to movements of said beam and a read-out connected to said load cells to display a numeric indication of said signals.

6. A wafer processing machine as set forth on claim 2 wherein said second means pivots said block about a pivot axis passing longitudinally of a face of said block and disposed in a plane of a wafer on said chuck to move said tape between a first position on one side of said chuck and a second position on an opposite side of said chuck.

7. A wafer processing machine as set forth on claim 1 wherein the working medium is a polishing medium for polishing a peripheral edge of a wafer on said chuck.

8. A wafer processing machine as set forth on claim 1 wherein the working medium is a grinding medium for removing an edge bead of material from a peripheral edge of a processed wafer on said chuck.

9. A wafer processing machine comprising a chuck for holding a wafer thereon for rotation about an axis of rotation passing transversely through said chuck;

a wafer edge processing unit for working a peripheral edge of a wafer on said chuck during rotation of said chuck, said processing unit including a first means for sequentially positioning a selected one of a plurality of working mediums against the peripheral edge of a wafer on said chuck and a second means for moving the selected working medium in a plane perpendicular to said chuck during rotation of said chuck to place the working medium in contact with at least one side of the wafer on said chuck.

10. A wafer processing machine as set forth in claim 9 wherein said first means includes an elongated block facing said chuck; a plurality of pairs of spools; a plurality of tapes, each tape being wound on and extending between a respective pair of said spools and over said block and having a working medium thereon; and a pair of clamps on opposite sides of said block for releasably clamping said tapes to opposite sides of said block.

11. A wafer processing machine as set forth in claim 10 wherein said first means includes an elongated facing plate movably mounted on said block and disposed in backing contact with said tapes, and sensing means for sensing movement of said facing plate towards said block in response to contact of said selected tape with a wafer on said chuck and emitting a responsive signal thereto as a measure of a contact force between said selected tape and a wafer on said chuck.

12. A wafer processing machine as set forth in claim 11 wherein said facing plate is made of rigid material and which further comprises an elastomeric layer having said rigid facing plate mounted thereon.

13. A wafer processing machine as set forth in claim 11 wherein said sensing means includes a beam mounting said facing plate thereon, a pair of load cells supporting said beam and emitting corresponding signals in reaction to movements of said beam and a read-out connected to said load cells to display a numeric indication of said signals.

14. A wafer processing machine as set forth on claim 10 wherein said second means pivots said block about a pivot axis passing longitudinally of a face of said block and disposed in a plane of a wafer on said chuck to move said selected tape between said first and second positions.

15. A wafer processing machine as set forth in claim 10 wherein said processing unit includes means for rotating at least one spool of each said pairs of spools to advance said tape thereon with said clamps spaced from said block.

16. A wafer processing machine as set forth in claim 9 which further comprises an indexing means for moving one of said chuck and said processing unit laterally of each other to sequentially position said working mediums in contact with a wafer on said chuck.

17. A wafer processing machine as set forth in claim 16 wherein each working medium has a different grade of abrasive surface from the other of said working mediums.

18. A wafer grinding and polishing machine comprising a grinding station for grinding a peripheral edge of a wafer;

a polishing station for polishing the peripheral edge of a wafer ground in said grinding station, said polishing station including a rotatable chuck for receiving a wafer thereon for rotation about an axis of rotation passing perpendicularly of said chuck and a polishing unit for polishing a peripheral edge of a wafer on said chuck during rotation of said chuck, said polishing unit including a first means for positioning a polishing medium in a first position against the peripheral edge of a wafer on said chuck and a second means for moving said first means in a plane perpendicular to said chuck during rotation of said chuck to move the polishing medium from against the peripheral edge of the wafer into contact with at least one side of the wafer on said chuck; and a conveyor for moving a wafer from said grinding station to said polishing station.

19. A machine as set forth in claim 18 wherein said first means includes an elongated block facing said chuck; a plurality of pairs of spools; a plurality of tapes, each tape being wound on and extending between a respective pair of said spools and over said block and having a polishing medium thereon; and a pair of clamps on opposite sides of said block for releasably clamping said tapes to opposite sides of said block.

20. A machine as set forth in claim 19 wherein said first means includes an elongated facing plate movably mounted on said block and disposed in backing contact with said tapes, and sensing means for sensing movement of said facing plate towards said block in response to contact of said selected tape with a wafer on said chuck and emitting a responsive signal thereto as a measure of a contact force between said selected tape and a wafer on said chuck.

21. A machine as set forth in claim 19 said second means pivots said block about a pivot axis passing longitudinally of a face of said block and disposed in a plane of a wafer on said chuck to move said selected tape between said first and second positions.

22. A machine as set forth in claim 19 which further comprises an indexing means for moving one of said chuck and said polishing unit laterally of each other to sequentially position said polishing mediums in contact with a wafer on said chuck.

23. A machine as set forth in claim 22 wherein each polishing medium has a different grade of abrasive surface from the other of said polishing mediums.

24. A processing unit for working an edge of a substrate, said working unit including a first means for positioning a working medium in a first position against an edge of a moving substrate; and a second means for moving said first means in a plane perpendicular to the substrate during movement of the substrate to move the working medium from against the edge of the moving substrate into contact with at least one side of the moving substrate.

25. A processing unit as set forth in claim 24 wherein said first means includes an elongated backing block facing the substrate, at least one pair of spools, a tape wound on and extending between said spools and over said block and having a working medium thereon, and a pair of clamps on opposite sides of said block for releasably clamping said tape to opposite sides of said block.

26. A processing unit as set forth in claim 25 wherein said first means includes an elongated facing plate movably mounted on said block and disposed in backing contact with said tape, and sensing means for sensing movement of said facing plate towards said block in response to contact of said tape with a substrate and emitting a responsive signal thereto as a measure of a contact force between said tape and the substrate.

27. A processing unit as set forth in claim 26 wherein said sensing means includes a beam mounting said facing plate thereon, a pair of load cells supporting said beam and emitting corresponding signals in reaction to movements of said beam and a read-out connected to said load cells to display a numeric indication of said signals.

28. A processing unit as set forth on claim 25 wherein said second means pivots said block about a pivot axis passing longitudinally of a face of said block to move said tape between a first position on one side of the substrate and a second position on an opposite side of the substrate.

29. A processing unit for working an edge of a wafer, said processing unit including a first means for positioning a working medium against an edge of a rotating wafer, said first means including a backing block facing the wafer, a facing plate movably mounted on said block and disposed in backing contact with a working medium, and sensing means for sensing movement of said facing plate towards said block in response to contact of the working medium with a wafer and emitting a responsive signal thereto as a measure of a contact force between the working medium and the wafer.

30. A processing unit as set forth in claim 29 wherein said sensing means includes a beam mounting said facing plate thereon, a pair of load cells supporting said beam and emitting corresponding signals in reaction to movements of said beam and a read-out connected to said load cells to display a numeric indication of said signals.

31. A processing unit as set forth in claim 30 which further comprises a second means for moving the working medium in a plane perpendicular to the wafer during rotation of the wafer to place the working medium in contact with at least one side of the rotating wafer.

32. A processing unit as set forth in claim 31 wherein said second means pivots said block about a pivot axis passing longitudinally of a face of said block to move the working medium between a first position on one side of the wafer and a second position on an opposite side of the wafer.

33. A processing unit as set forth in claim 29 wherein the working medium is a tape having one of a polishing medium and a grinding medium thereon and said first means further includes a pair of clamps on opposite sides of said block for releasably clamping said tape to opposite sides of said block.

* * * * *